US005732795A

United States Patent [19]

McCarthy et al.

[11] Patent Number: 5,732,795

[45] Date of Patent: Mar. 31, 1998

[54] POWER AND COMMUNICATION FOR ELEVATOR CAR WITHOUT TRAVELING CABLE

[75] Inventors: Richard C. McCarthy, Simsbury; Joseph Bittar, Avon, both of Conn.

[73] Assignee: Otis Elevator Company, Farmington, Conn.

[21] Appl. No.: 632,380

[22] Filed: Apr. 10, 1996

[51] Int. Cl.[6] ..... B66B 9/02

[52] U.S. Cl. ..... 187/250; 187/290

[58] Field of Search ..... 187/250, 266, 187/277, 289, 290; 318/140, 150

[56] References Cited

U.S. PATENT DOCUMENTS 4,657,117 4/1987 Lauer ..... 187/114

*Primary Examiner*—Kenneth Noland

[57] ABSTRACT

Normal power for the fan (22), lights (23), operating car panel (26), and cab controller functions (29) is provided from a voltage regulator (41) driven by a flywheel motor generator (38) which is accelerated when the elevator car (11) is near a landing by power supplied through brushes (34) from power tracks (32) disposed on the building (33). Power for the cab door operator (21) is supplied only directly from the brushes (34). A transceiver (46) provides all operational, safety and emergency phone voice communication with the building, whereby the traveling cable normally used on an elevator car is eliminated. The brushes are extended to engage the power tracks by means of springs (176), and are retracted into a clearance position by means of solenoids (174).

7 Claims, 5 Drawing Sheets

POWER AND COMMUNICATION FOR ELEVATOR CAR WITHOUT TRAVELING CABLE

TECHNICAL FIELD

This invention relates to utilizing a radio transceiver for communications with an elevator car, providing door operation power directly from the building while the car is near landings, and using a flywheel motor generator to provide power to the cab when it is not near a landing, thereby to eliminate the need for a traveling cable connected to the elevator car.

BACKGROUND ART

It is well known that elevator cars typically employ a traveling cable connected between the bottom of the elevator car and the machine room at the top of the hoistway. The traveling cable provides power for operating the doors, for lighting and the fan, and for powering the control and display apparatus, which includes communicating the status of buttons and switches on the car operating panel (car calls, emergency bell), as well as an emergency phone. In high rise buildings, traveling cables are very costly and are prone to fouling in high wind/building sway conditions. Government codes for elevators require that emergency power be provided for emergency lighting and signaling devices in the cab, apart from the building. Traditionally, emergency power has been provided by a battery pack. Batteries are difficult to maintain properly, and pose environmental problems both during and at the end of their service lives.

DISCLOSURE OF INVENTION

Objects of the invention include elimination of the known elevator car traveling cable, and elimination of batteries as a source of emergency power for an elevator cab.

According to the present invention, an elevator cab is provided with a flywheel motor/generator which is accelerated by building power when it is at or near a landing during normal operating conditions, and which supplies power to the cab for everything except door operation. According to the invention, the door operator of an elevator cab is powered through contacts made between the cab and the building while the car is near a landing. According to the invention, all signaling, including car operation, safety and device data as well as emergency telephone voice, are communicated from the elevator cab to the building by a radio transceiver. According to the invention still further, the flywheel motor generator provides power to a voltage regulator which in turn provides suitable voltages for operating lights, fan, transceiver, car operating panel, telephone and emergency lighting, when applicable. According still further to the invention, a controller may switch from normal lights and fan to emergency lighting under emergency conditions, thereby allowing the flywheel motor generator and voltage regulator to constitute the emergency power supply required by government regulations, if desired.

In accordance with the invention, power to an elevator car is provided when the car is near a landing by means of power tracks disposed on a structure within the hoistway and retractable brushes. The retractable brushes, in one form, comprise brushes resiliently disposed to a frame and a spring loaded solenoid to move said frame toward said power tracks in response to urging of the spring and for retracting said frame away from said power tracks by applying power to the solenoid.

Other objects, features and advantages of the present invention will become more apparent in the light of the following detailed description of exemplary embodiments thereof, as illustrated in the accompanying drawing.

BEST MODE FOR CARRYING OUT THE INVENTION

Figure 1:
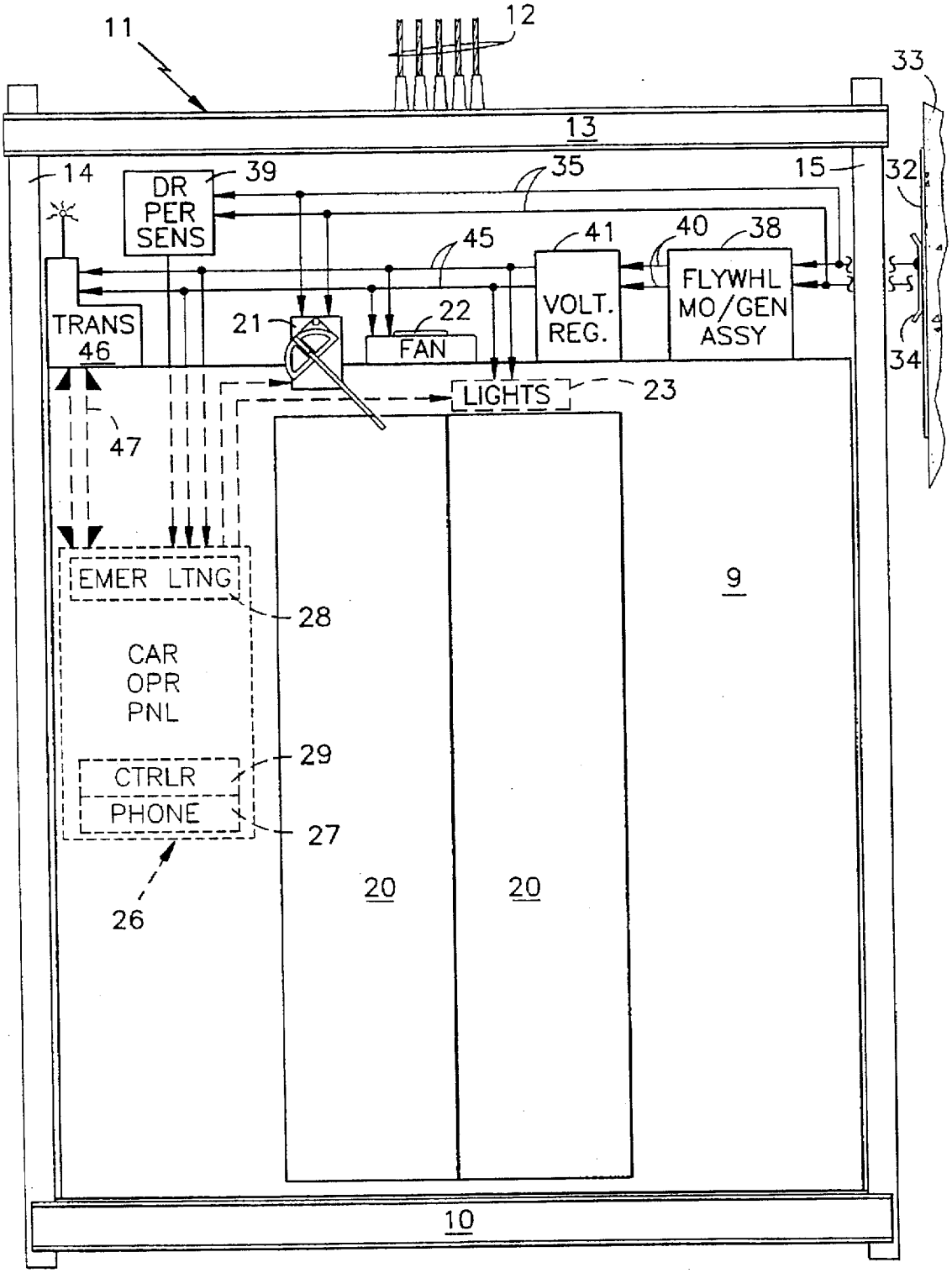
FIG. 1 is a stylized, simplified front elevation view of an elevator car incorporating the present invention.

Referring now to FIG. 1, an elevator cab 9 is supported by the plank 10 of an elevator car 11 which is supported by roping 12 attached to a crosshead 13 that is connected with the plank 10 by means of stiles 14, 15. The stiles 14, 15 may support the usual hoistway track guides and safeties (not shown). The cab 9 has the usual door or doors 20, door operator 21, fan 22 and lights 23. The cab 9 also has the usual car operating panel 26 which may include the conventional car call buttons, door buttons, emergency bell button and the like. The panel 26 may contain the usual emergency phone 27, and emergency lighting 28 (which however may be actually mounted elsewhere within the cab 9). The car operating panel 26 also contains, or is otherwise associated with, a controller 29, which typically monitors the door buttons and door safety sensors, and communicates with the car controller in the machine room with respect to the condition of the doors, the emergency bell button, communications over the phone, and so forth. In the present example, some of these functions are illustrated as they may be adopted to promote the use of the present invention.

In accordance with the invention, the car 11 is not provided with a traveling cable, so that power, phone communications, car operating and dispatching information, the emergency bell and phone, etc., all must be provided for in some other fashion. According to the invention, a pair of power tracks 32, only one of which is shown in FIG. 1, are attached to the building 33 or other structure within the hoistway. The power tracks are disposed in the hoistway with respect to the position of the car 11 when it is near a landing so as to make contact with a pair of brushes 34, only one of which is shown in FIG. 1, each of which makes sliding contact with a corresponding one of the tracks 32. In this embodiment, the length of the power tracks 32 need only extend through the extent of hoistway within which opening of the doors of the cab 11 is desired, whether it be traveling upwardly or downwardly. This is equivalent to the normal outer door zone. Power supplied from the building through the tracks 32 and brushes 34 is applied over a pair of power lines 35 directly to a flywheel motor/generator assembly 38 and to the door operator 21. If AC power is used (as preferred), the door operator 21 may nonetheless utilize a DC motor with suitable DC power conversion and conditioning included in the door operator 21. The lines 35 are also applied to a door power sensor 39 so as to provide an indication thereof to the controller 29 for monitoring purposes, as is described hereinafter. An important aspect of the present invention is that the doors 210 are not operated unless the car is connected with building power through the tracks 32 and brushes 34. This eliminates the need for a source of significant onboard power.

Figure 7:
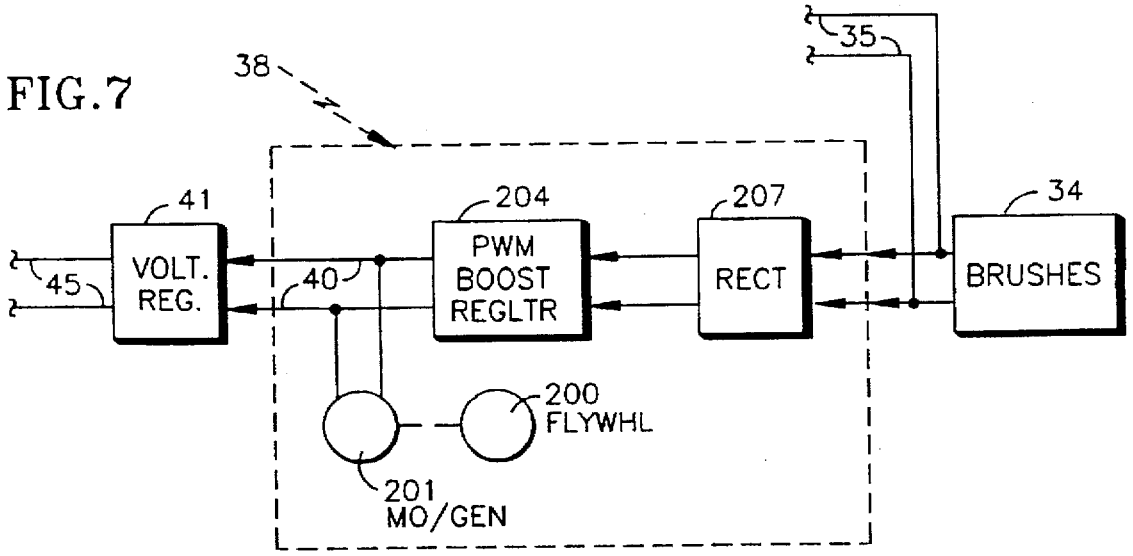
FIG. 7 is a partial, simplified schematic block diagram of details of the flywheel motor generator assembly of FIG. 1.

Another aspect of the present invention is that the flywheel motor/generator assembly 38 has a substantial flywheel 200, FIG. 7, of a conventional sort, and a motor/generator 201 which operates as a motor and accelerates the flywheel whenever it receives power on a pair of lines 40 from a pulse width modulated boost regulator 204 at a voltage higher than the current back EMF of the motor/generator, as is known. AC power is applied by the lines 35 to a rectifier 207 which provides DC voltage to the PWM boost regulator 204, which uses switched inductance and capacitance to provide as high a voltage as necessary to drive the motor generator 201, and also applies that voltage to the DC/DC voltage regulator 41 over the lines 40. The flywheel achieves significant inertia, and the energy represented thereby is converted to electrical energy provided over the power lines 40 to a voltage regulator 41 whenever the voltage of the motor generator is higher than the voltage from the PWM boost regulator 204; that is, when no power is fed to the boost regulator from the brushes. In other words, the motor generator assembly 38 is simply an energy recovery system, where energy is stored in the rotational velocity of the flywheel and returned to the voltage regulator 41. The flywheel may be formed integrally with the motor/generator armature, or not.

The voltage regulator 41 provides suitable DC power over a pair of lines 45 to operate the fan 22, the lights 23, and the car operating panel 26, including the emergency phone 27, the emergency lighting 28 and the controller 29. Power on the lines 45 is also provided to a transceiver 46 over which all communication with the car controller and group controller (if any) in the building is conducted. The transceiver is connected by a trunk of suitable lines 47 with the car operating panel 26. Thus, all the power for normal operation of the cab 9, except the door operator 21, is provided by the voltage regulator 41 in response, alternatively, to the motor/generator 201 while the car is in transit between landings, or the PWM boost regulator 204 while the car is at a landing. However, when the car is standing at a landing, it is not consuming stored energy represented by the inertial energy of the rotating flywheel 200, but rather the flywheel is being accelerated by motor action of the motor/generator 201.

Figure 2:
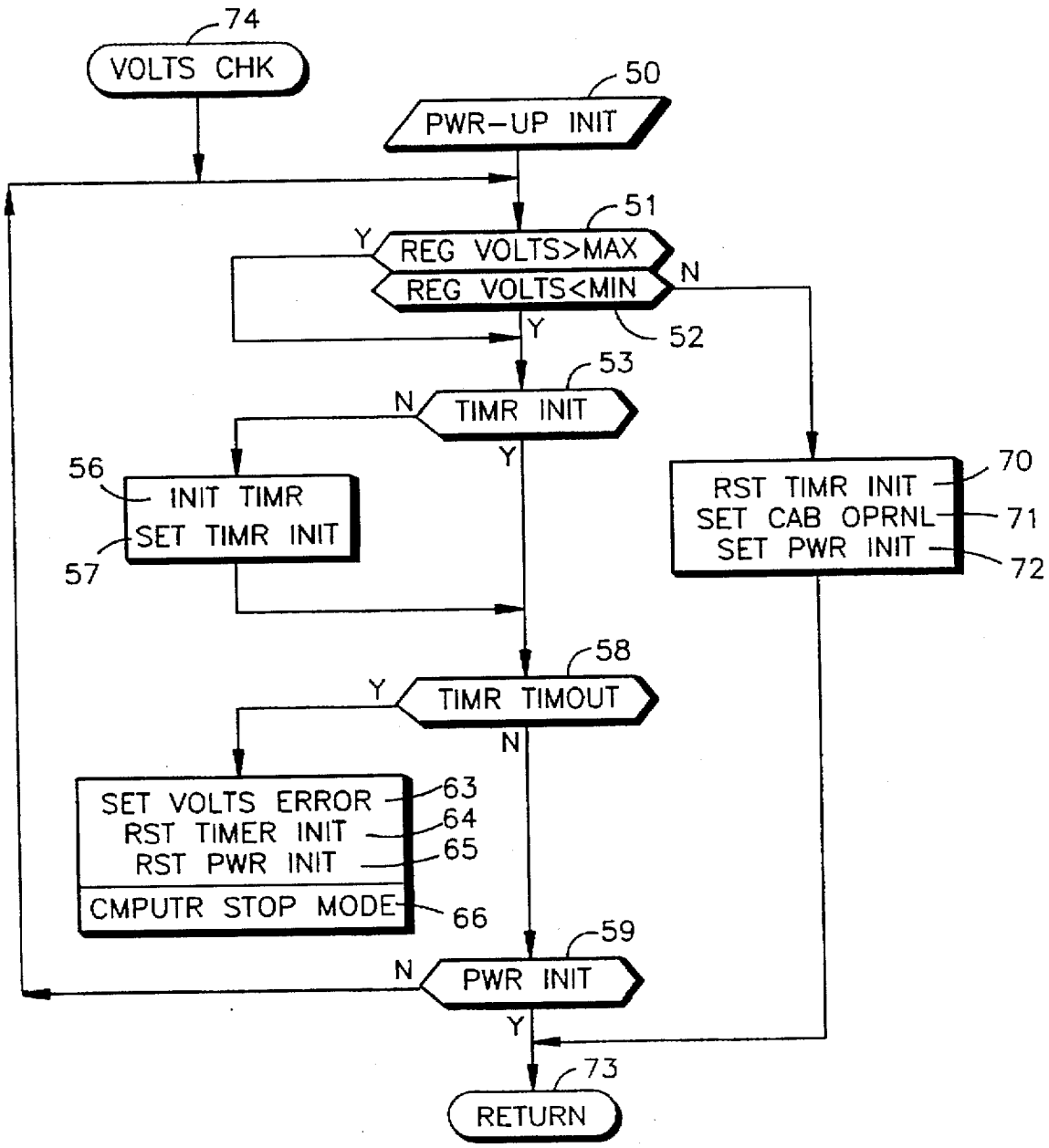
FIG. 2 is a logic flow diagram of an exemplary simplified power up initialization and voltage checking routine for use with the invention of FIG. 1.
Figure 3:
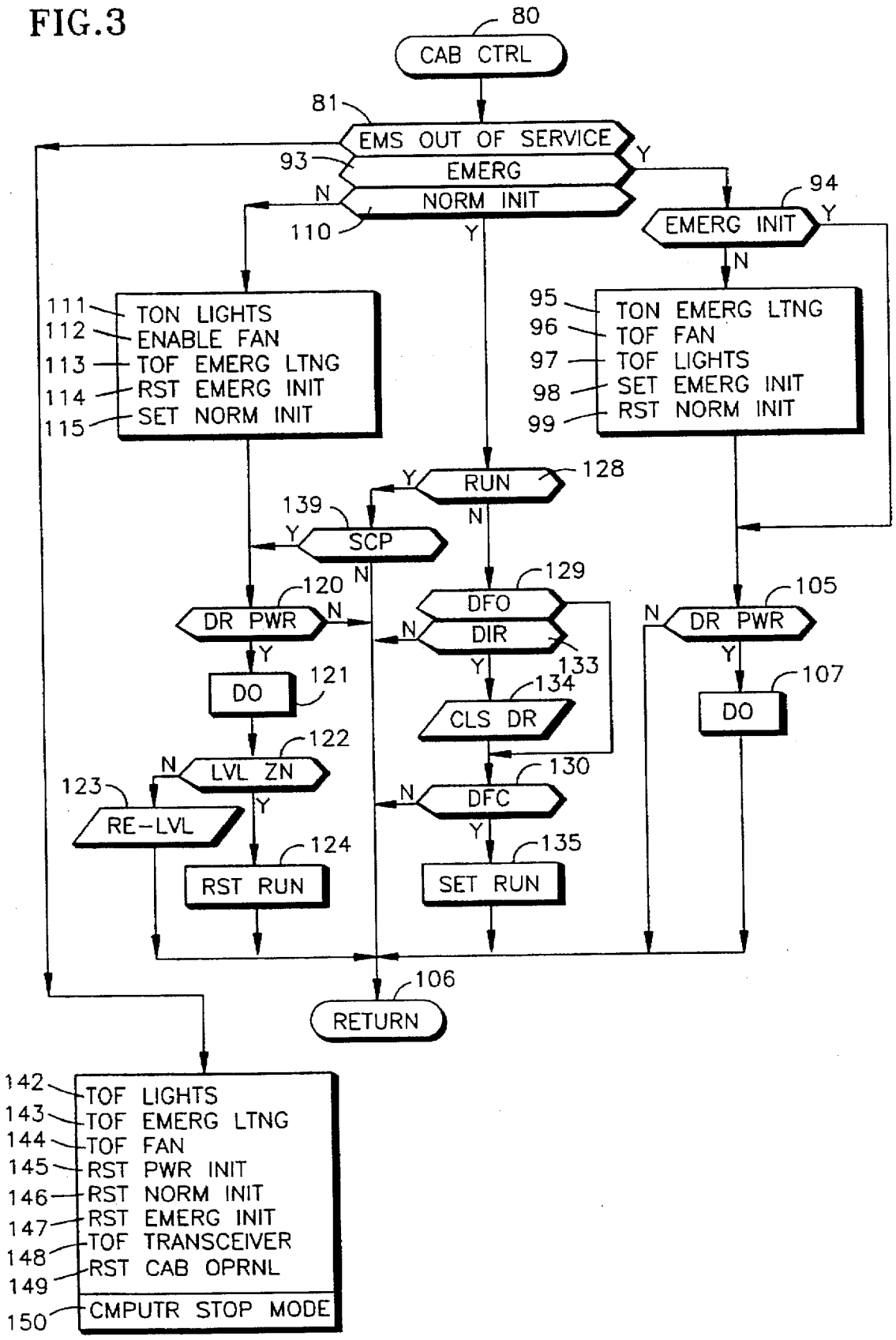
FIG. 3 is a logic flow diagram of an exemplary, stylized cab control routine for use with the invention of FIG. 1.

FIGS. 2 and 3 are illustrative of functions which may be associated with the apparatus of the invention, but do not represent actual controls for an elevator. For instance, a number of the functions illustrated in FIG. 3 are typically performed in a car controller at the top of the hoistway, rather than in the cab. But, to clarify the issues herein, these functions are shown as being within the cab control routine. The controller 29 may typically be completely powerless and off whenever there is no voltage at all provided by the voltage regulator 41. Such might be the case when the car 11 is taken totally out of service and power is removed from the power rails 32 (such as in the middle of the night, when the car may not be needed). To place the car in operation, the building elevator management system (EMS), or other control, provides power to the power rails 32, and similar power rails near all of the landings of the hoistway. The motor generator 201 will commence rotating the flywheel and the voltage regulator 41 will provide power on the lines 45.

When the controller 29 receives power, it will perform a power up initialization routine 50, shown in FIG. 2. Then a pair of tests 51, 52 determine if the regulated voltage on the lines 45 is either greater than a maximum voltage or less than a minimum voltage; if so, a test 53 determines if a timer initialized flag has been set, or not. Initially, it will not have been, so a negative result of test 53 will reach a step 56 to initialize a timer, and a step 57 to set the timer initialized flag. A test 58 then determines if the timer has timed out, or not. Initially it will not have, so a negative result of test 58 reaches a test 59 to see if a power initialized flag has been set or not. In the first pass through the routine it will not be set, and a negative result of test 59 causes the program to revert to the tests 51 and 52 to once again determine if the regulated voltage on the lines 45 is within limits. If it is still outside of limits, an affirmative result of either test 51 or 52 will reach the test 53 which now is affirmative since the timer initialization flag was set in step 57. This reaches the test 58 to see if the timer has timed out, or not. If the timer has timed out, an affirmative result of test 58 reaches a step 63 to set a volts error flag that can be interpreted by the elevator management system, to indicate that the cab is not running because of improper voltage. Then, a step 64 will reset the timer initialized flag, a step 65 will reset the power initialized flag and the computer will enter the stop mode at a point 66. It is assumed that power will be removed from the power rails 32 during diagnostics and repair and then power restored to the power rails 32, thus inducing another power up initialization routine 50.

If during initialization, both tests 51 and 52 are negative, indicating that the regulated voltage is not out of limits, a step 70 will reset the timer initialized flag, a step 71 will set a cab operational flag for the EMS to sense, and a step 72 will set a power initialized flag indicating that the system has in fact been initialized once. And then, other programming is reverted to through a return point 73. In this embodiment, FIG. 2 also represents a voltage check routine which can be reached as frequently as desired through an entry point 74. In such case, operation is as described hereinbefore with the exception that, before the timer times out, a negative result of test 58 reaching test 59 will find an affirmative result so that other programming is reached through the return point 73. If in successive passes through the routine of FIG. 2 from the entry point 74, one of the tests 51 or 52 continues to be affirmative, eventually the timer will have timed out and an affirmative result of test 58 will reach the steps 63–66 to reset the flags, notify the EMS of a voltage error and put the computer in a stop mode. But if tests 51 and 52 are both negative, step 70 will reset the timer initialized flag, steps 71 and 72 will be redundantly performed, and other programming reached through point 73.

In the present invention it is assumed that the lights 23 consume several times more power than the emergency lighting 28. Therefore, the principle function in case of emergency is to switch from the lights 23 to the emergency lighting 28 in order to conserve energy while maintaining the other functions that are required, such as operating the transceiver 46 to communicate cab condition and use of the emergency phone 27.

In FIG. 3, a cab control routine is reached through an entry point 80 and a first test 81 determines if the elevator management system (or other control) has placed the cab out of service, or not. If the car has not been placed out of service, a negative result of test 81 reaches a step 93 to see if an emergency condition exists. If it does, an affirmative result of test 93 reaches a test 94 to see if an emergency initialized flag has been set yet, or not. Initially, it will not have been so a negative result of test 94 reaches a step 95 to turn on the emergency lighting, a step 96 to turn off the fan, a step 97 to turn off the lights, a step 98 which sets the emergency initiated flag, and a step 99 which resets the normal initiated flag, which is described hereinafter. Then, a test 105 determines if the door power sensor 39 indicates that there is power for the doors (that is, the shoes 34 are on the power tracks 32 and power is applied to the power tracks 32). If not, other programming is reverted to through a return point 106. However, emergency power will normally be applied to the tracks 32 if at all possible, so that if the car is sufficiently close to a landing that the brushes 34 make contact with the tracks 32, the door power sensor 39 will indicate that there is door power available. In such a case, an affirmative result of test 105 will reach a step 107 to issue a door open command, after which other programming is reached through the return point 106. During the emergency, in subsequent passes through the routine of FIG. 3, test 81 may still be negative and test 93 affirmative reaching the test 94, which is now affirmative, reaching the step 105 to see if power is available or not. Since an emergency condition can occur when a cab is anywhere, it is quite likely that there may be many passes through an affirmative result of test 94 and a negative result of test 105 before the cab may be brought near a landing. Once the cab is near a landing and test 105 is affirmative, in subsequent passes through the routine of FIG. 3, there will be redundant issuing of a door open command by step 107, but this is harmless.

Government codes of regulations for elevators require that elevator emergency lighting and phones be capable of operating for some period of time, such as two hours, without building power. To accommodate such a regulation, the flywheel motor generator 38 may be designed and sized accordingly. On the other hand, if desired, emergency power requirements may be met in the usual fashion, such as with batteries. This is irrelevant to the invention.

If the elevator is not out of service and there is no emergency, negative results of tests 81 and 93 reach a test 110 to determine if normal operation has been initiated, or not. When the car first starts up, or immediately following an emergency condition which is cleared, normal operation will not have been initiated so a negative result of test 110 reaches a step 111 to turn on the lights 23, and a step 112 to enable the fan, which may either turn the fan on, or power up a key switch which can be used to turn on the fan. A step 113 turns off the emergency lighting, a step 114 resets the emergency initialized flag which may have previously been set, and a step 115 sets the normal initialized flag.

Initialization of operation for the cab may occur after the cab is first placed in service, or it may occur after clearing an emergency situation. If the car was out of service, it may have been standing at a landing with its doors closed. If the car was in service but an emergency condition has just been cleared, the car is most likely standing at a landing with the doors open. However, the car may not be level and therefore suitable for passengers. Therefore, in either case, initialization also requires ensuring that the doors are open and the car is level. Therefore, a test 120 is reached to see if there is door power. If there is not, other programming is reached through the return point 106 which would indicate that the car is being started up at other than the landing, and the doors must remain closed until the car reaches a landing. This could occur in an emergency which included a failure of emergency power for any reason. However, in the normal case, an affirmative result of test 120 will reach a step 121 to issue a door open command and then a test 122 determines if the car is level or not. If it is not, a releveling routine 123 may be reached and then other programming reverted to through the return point 106. In this embodiment it is assumed that within the releveling routine, once the car is level the run command for the car will be reset. On the other hand, if the car was already leveled, an affirmative result of test 122 reaches a step 124 to reset the run command for the car, and then other programming is reached through the return point 106.

In the next pass through the routine of FIG. 3, negative results of tests 81 and 93 reach test 110 which is now affirmative, reaching a test 128 to determine if the run command is set, or not. Immediately following startup, test 128 is normally going to be negative, reaching a test 129 to see if the doors are fully open or not. After the doors have been ordered to be opened, but have not been fully opened, a negative result of test 129 will reach test 130 to see if the doors are fully closed. While they are opening, they will not be fully closed so a negative result of test 130 reaches other programming through the return point 106. Eventually, the doors become fully open reaching a test 133 to see if the car has direction or not. At this point, it will not have, so other programming is reached through the return point 106. While the car is loading passengers, in subsequent passes through the routine of FIG. 3, tests 81 and 93 are negative, test 110 is affirmative, test 128 is negative, test 129 is affirmative, and test 133 is negative reaching other programming through the return point 106. Eventually, the car is ready to run and will be provided with a direction command (to either run upwardly or run downwardly). In the next pass through the routine of FIG. 3, an affirmative result of test 133 reaches a close door subroutine 134, which issues a close door command and monitors the door open button and the door safety switches to cause door reversal should it be required, until the door becomes fully closed. This is shown as being part of the routine of FIG. 3, but typically, may be reached periodically with other programming being performed interleaved therewith in the usual fashion. Eventually, with the doors closed, the test 130 is reached and is affirmative, reaching a step 135 to set the run command for the car.

With the run command set, the car responds to a motion controller in a normal fashion. During this time, in repetitive passes through the routine of FIG. 3, tests 81 and 93 are negative, and tests 110 and 128 are affirmative, reaching a test 139 to see if the car has reached the stop control point for the target landing, or not. During many initial passes through the routine of FIG. 3, the car will be traveling toward the intended landing and will not have yet reached the stop control point for that landing. A negative result of test 139 therefore causes other programming to be reverted to through the return point 106. Once the car has reached the stop control point of the target landing, an affirmative result of test 139 reaches the test 120 to see if the car is sufficiently close to the landing (such as within the outer door zone) so that the brushes 34 have made contact with the power rails 32 and the door power sensor 39 is providing a signal indicating that there is door power available. If so, the door open command is issued in step 121, leveling is checked in step 122 and either perfected by the routine 123 or caused to reset the run command directly in step 124, after which other programming is reverted to through the return point 106.

The EMS (or other control) may take the car out of service at any time, typically late in the day. If it has, this will be after the car has been emptied and the doors closed, and there is nothing left to do but turn off the other functions in the cab. Thus, an affirmative result of test 81 reaches a plurality of steps 142–144 to turn off the lights, the emergency lighting and the fan, a plurality of steps 145–147 to reset the power initialized, normal initialized and emergency initialized flags, a step 148 to turn off the transceiver, a step 149 to reset the cab operational flag, after which the computer goes into the stop mode at point 150.

In the routine of FIG. 3, there is much communication between the car controller at the top of the hoistway and the controller 29 within the cab. For instance, the run command is issued by the car controller and the test 128 responds thereto. The fact of the doors being fully open is communicated to the car controller which will then establish direction, so that the car controller has to inform the cab controller of the result of test 133. The closed door routine is generally performed fully within the cab. The result of test 130 that the doors are fully closed is communicated to the car controller which in turn sets the run command. Similarly, the steps and tests 122–124 respecting leveling and resetting of run command are performed by the car controller. The test 139 is performed in the car controller and the result provided to the cab controller 29.

The power rails 32 and brushes 34 have been shown placed to the side of the cab in FIG. 1. However, it is preferred in most cases that the power rails 32 and brushes 34 will be placed on the building at the front of the cab, in the fashion similar to vane operated zone and safety devices. The invention has been described as powering certain functions of an elevator cab. Obviously, it can power other functions of an elevator cab if desired. The routines described in FIGS. 2 and 3 are illustrative, merely, of how the invention might interact with other, known functions in elevator systems known to the art. Fewer than all of the functions described in FIGS. 2 and 3 may be employed with the invention if desired. Other functions may be accommodated, and any functions may be performed in ways different than as described in FIGS. 2 and 3.

In the present embodiment, the power rails 32 are disclosed as being only as long as is necessary for door operation. This prevents the need for having good catenary-type contact throughout the building. However, if desired, the invention may be used with continuous tracks to take advantage of that aspect of it which separates door power from power required during emergencies that is supplied by the inertia of a flywheel.

Figure 4:
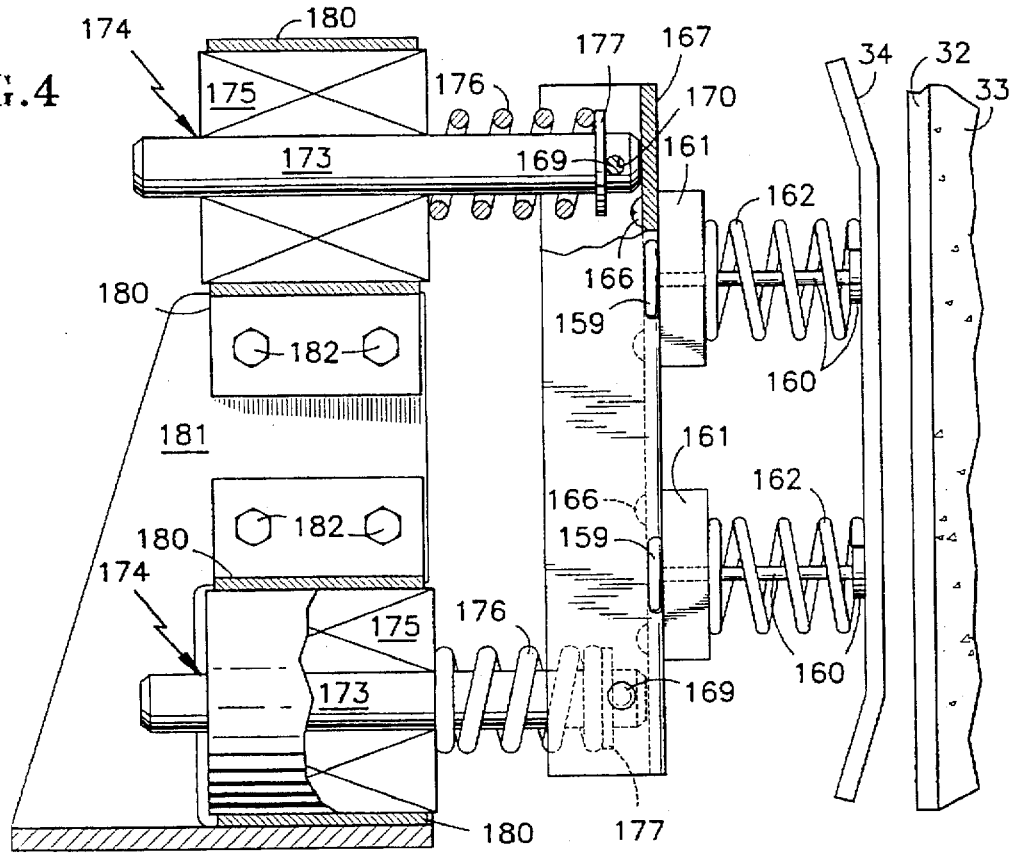
FIG. 4 is a partially sectioned, partially broken away front elevation view of retractable brushes in accordance with the present invention.
Figure 5:
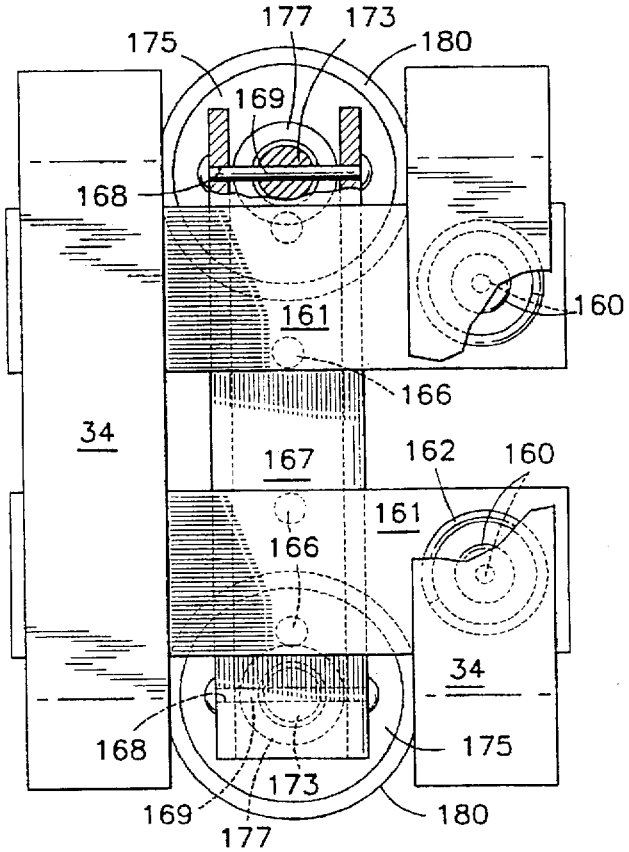
FIG. 5 is a partially sectioned, partially broken away side elevation view of the retractable brushes of FIG. 4.

In FIGS. 4 and 5, each of the brushes 34 has a pair of stems 160 metallurgically bonded thereto, each stem extending through an insulator block 161 that extends horizontally between the pairs of brushes 34. At the far end of the stem, on the other side of the blocks 161, each stem has a head 162 so as to limit the movement of the brushes 34 with respect to the blocks 161. Disposed between each of the brushes 34 in each of the blocks 161 there is a relatively light compression spring 162 that allows both ends of both brushes to have a slight vertical misalignment with respect to other ends of the same or the other brushes. In other words, the springs 162 simply allow the brushes to align themselves perfectly with the surface of the conductors 32. Each of the blocks 161 is secured by screws 166, or in some other suitable fashion, to the base of a U-shaped channel 167, the sidewalls of which each have two holes 168 therein (FIG. 5), opposing pairs of which receive rivets or pins 169 which pass through holes 170 in corresponding armatures 173 of solenoids 174. Each solenoid has a coil 175, and a heavy compression spring 176 extending between the solenoid and a washer 177 which seats the spring 176 on the pin 169. Each solenoid 174 may have a frame 180 secured to a bracket 181 by bolts 182, or the like. The bracket may be secured in any suitable fashion, so as to place the brushes 34 in a proper position upon the cab 11 (FIG. 1) so as to engage the conductors 32 in an appropriate fashion.

In FIG. 4, the shoes 34 are shown at about mid position being extended and retracted. The brushes 34 may be much wider (right to left as seen in FIG. 5) than the conductors 32 to avoid necessity for careful alignment. The embodiment herein is extended, to make contact between the brushes 34 and the conductors 32, by means of the springs 176. It is assumed that the armature is permanently magnetized, with a north pole at one end and a south pole at the other end, so that current in the appropriate direction within the coils 175 will cause retraction of the brushes against the force of the springs. If desired, current of the opposite direction may be used to assist the springs in seating the brushes at each landing. On the other hand, other arrangements may be made.

Figure 6:
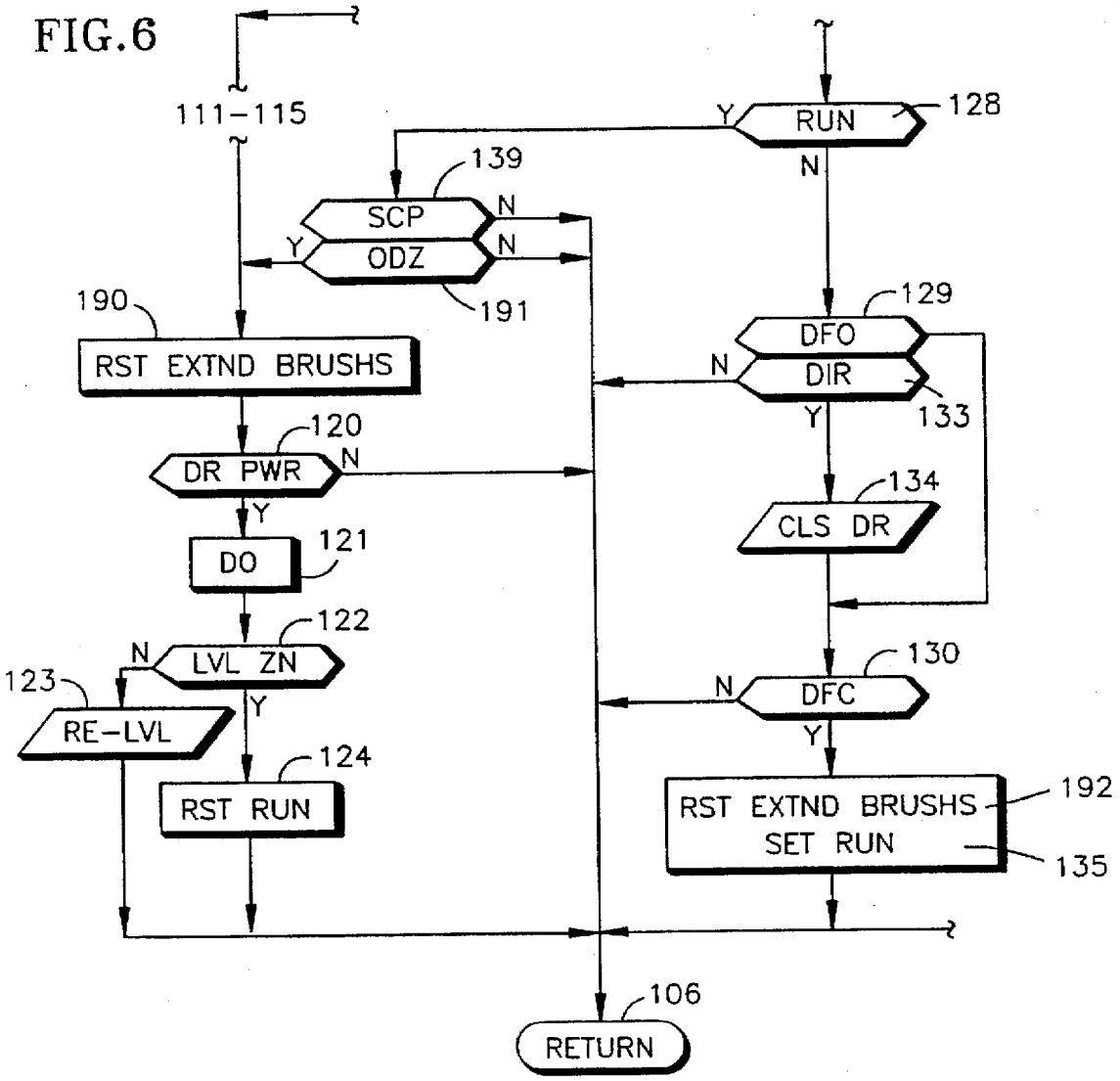
FIG. 6 is a partial, logic flow diagram of a modification of the cab control routine of FIG. 3 to accommodate the retractable brushes of FIGS. 4 and 5.

To accommodate the retractable brushes of FIGS. 4 and 5, the cab control routine of FIG. 3 is modified slightly as shown in FIG. 6. The first change is that during normal initialization, after steps 111–115, the brushes are extended in a step 190 before testing for door power in test 120. A second change is within normal runs, as determined by test 128, after the stop control point for the target floor is identified by the test 139, a test 191 determines when the car has reached the outer door zone. In order to accommodate these changes, the outer door zone may be made one or two centimeters longer than usual to provide time to extend the brushes. Once the outer door zone is reached, an affirmative result of test 191 reaches the step 190 to set the extend brushes flag. In the embodiment of FIGS. 4 and 5, setting the extend brushes flag will cut off power to the coils 175 (or reverse current in the coils 175, if so desired) to allow the springs 176 to fail-safely extend the brushes 34 into contact with the power tracks 32. The third change in FIG. 6 is that at the end of a run, when the doors are fully closed as indicated by the test 130, a step 192 will reset the extend brushes flag, causing current to once again be applied to the coils 175 in a direction to pull the armatures toward the car thereby retracting the brushes 34 from the power track to provide clearance therebetween.

The invention may be used in conventional elevators which stop at landings selected from a series of landings by passengers, and which stop at landings when called thereto by passengers. The invention may also be utilized in high rise express elevators, used as shuttles, in which passengers only travel between a lower lobby and a higher lobby floor. The invention may also be used in a new type of elevator in which the elevator cab itself is transferred from a car frame in one hoistway, to a car frame in another hoistway, so that a complete trip involves travel in more than one hoistway. In such a case, the invention is well suited to provide the power and other services necessary during transfer from one hoistway to another. Of course, the brushes should be mounted to each cab, not to any car frame. In the case of extremely long runs, the flywheel may have to have a higher inertial energy storage capacity than in the case of ordinary elevators typically moving only a few floors in each run. However, all of this is obvious in the light of the teachings hereinbefore, and irrelevant to the present invention.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. An elevator system including a car disposed for travel within a hoistway of a building, comprising:

a pair of power tracks mounted adjacent each landing within the hoistway of the building;

a pair of brushes disposed on said car for contacting said power tracks when adjacent thereto;

a first radio transceiver disposed in said building;

an elevator car adapted to travel within the hoistway between the landings of the building;

an elevator cab having a door, a door operator, a car operating panel and lights;

a flywheel motor generator disposed on said car;

a second radio transceiver disposed on said car for communication between said cab and said first radio transceiver; and circuitry for connecting said flywheel motor generator and said door operator to said brushes and for powering said transceiver, lights, and car operating panel from the output of said flywheel motor generator, whereby to operate said cab without a traveling cable.

2. An elevator according to claim 1 wherein said cab includes a fan and emergency lighting, and said circuitry includes means for alternatively enabling the power to said fan and providing power to said lights during normal operation, or not providing power to said lights and said fan while providing power to emergency lighting during an emergency condition.

3. An elevator according to claim 1 wherein said brushes are resiliently disposed on a frame;

a spring for urging said frame toward said power tracks; and a solenoid for overcoming said spring and retracting said frame toward said car, whereby to provide clearance between said brushes and said power tracks to facilitate relative movement therebetween.

4. A method of operating an elevator car without a traveling cable, comprising the steps of:

powering the car door operator with power picked up by brushes mounted on the elevator car from power tracks mounted on the building in the vicinity of each landing;

communicating with said car by means of radio transceivers; and powering said transceiver and functions of said car other than said door operator, including lights and a car operating panel, by means of a flywheel motor generator which is accelerated by power from said brushes and said power tracks.

5. A method according to claim 4 wherein said first step comprises providing a retractable set of brushes mounted on the elevator car;

extending said brushes to make contact with power tracks mounted on the building when said car is in the vicinity of each landing; and powering the car door operator with power picked up by said brushes when extended.

6. An elevator system including a car disposed to travel within a hoistway of a building, comprising:

a pair of power tracks mounted adjacent each landing within the hoistway of the building;

a pair of brushes resiliently disposed to a frame; and a spring loaded solenoid mounted on said car for extending said frame toward said power tracks in response to urging of said spring, and for retracting said frame toward said car to provide clearance between said brushes and said power tracks when power is applied to said solenoid.

7. An elevator system including a car disposed to travel within a hoistway of a building, comprising:

a pair of power tracks mounted adjacent each landing within the hoistway of the building;

a pair of brushes resiliently disposed to a frame;

a spring loaded solenoid mounted on said car for extending said frame toward said power tracks in response to urging of said spring, and for retracting said frame toward said car to provide clearance between said brushes and said power tracks when power is applied to said solenoid;

a first radio transceiver disposed in said building;

an elevator car adapted to travel within the hoistway between the landings of the building;

an elevator cab having a door, a door operator, a car operating panel and lights;

a flywheel motor generator disposed on said car;

a second radio transceiver disposed on said car for communication between said cab and said first radio transceiver; and circuitry for connecting said flywheel motor generator and said door operator to said brushes and for powering said transceiver, lights, and car operating panel from the output of said flywheel motor generator, whereby to operate said cab without a traveling cable.

* * * * *